US005407274A

United States Patent [19]

Woerheide et al.

[11] Patent Number: 5,407,274

[45] Date of Patent: Apr. 18, 1995

[54] DEVICE TO EQUALIZE STEAM QUALITY IN PIPE NETWORKS

[75] Inventors: Edward A. Woerheide, Houston; James R. Stoy, Missouri City; Mark T. Rubel, Houston, all of Tex.

[73] Assignee: Texaco Inc., White Plains, N.Y.

[21] Appl. No.: 199,928

[22] Filed: Feb. 22, 1994

Related U.S. Application Data

[63] Continuation-in-part of Ser. No. 982,354, Nov. 27, 1992, abandoned.

[51] Int. Cl.[6] ..... B01F 5/06

[52] U.S. Cl. ..... 366/337; 138/42; 137/561 A

[58] Field of Search ..... 366/336–340; 138/37, 38, 40, 42, 44; 165/109.1; 137/4, 8, 896, 561 A; 261/112.2, DIG. 76; 48/180.1, 189.4, 189.6

[56] References Cited

U.S. PATENT DOCUMENTS

| | | | |
|---|---|---|---|
| 1,095,555 | 5/1914 | Crone | 138/40 X |
| 1,473,052 | 11/1923 | Shaw | 138/37 X |
| 1,486,760 | 3/1924 | Johnson et al. | 138/37 X |
| 3,599,943 | 8/1971 | Munters | 261/112.2 X |
| 3,785,620 | 1/1974 | Huber | 261/112.2 X |
| 3,871,624 | 3/1975 | Huber et al. | 366/337 |
| 3,918,688 | 11/1975 | Huber et al. | 261/112.2 X |
| 4,062,524 | 12/1977 | Brauner et al. | 366/340 |
| 4,597,916 | 7/1986 | Chen | 261/112.2 X |
| 4,731,229 | 3/1988 | Sperandio | 366/336 X |
| 4,902,418 | 2/1990 | Ziegler | 366/337 X |
| 4,919,541 | 4/1990 | Grosz-Roell et al. | 138/42 X |

FOREIGN PATENT DOCUMENTS

| | | | |
|---|---|---|---|
| 1959110 | 6/1971 | Germany | 366/336 |
| 2509784 | 11/1975 | Germany | 366/337 |
| 3631311 | 3/1988 | Germany | 366/336 |
| 55-47129 | 4/1980 | Japan | 366/336 |
| 1153965 | 5/1985 | U.S.S.R. | 366/340 |

OTHER PUBLICATIONS

Koch Engineering Company Static Mixing Technology Bulletin KSM-5, 1986.

*Primary Examiner*—David A. Scherbel
*Assistant Examiner*—Charles Cooley
*Attorney, Agent, or Firm*—Kenneth R. Priem; James L. Bailey; William J. Beard

[57] ABSTRACT

Steam quality at both outlets of a T junction is equalized by a static mixer immediately adjacent the inlet to the junction causing substantial homogenization of the liquid and vapor phases of wet steam entering the junction so that the steam exiting both legs of the junction will have substantially the same quality as the steam entering the junction.

6 Claims, 3 Drawing Sheets

DEVICE TO EQUALIZE STEAM QUALITY IN PIPE NETWORKS

BACKGROUND OF THE INVENTION

The present application is a continuation-in-part of our patent application Ser. No. 07/982,354 filed Nov. 27, 1992, now abandoned.

FIELD OF THE INVENTION

The present invention is intended to equalize the quality of wet-steam in the outlet legs of an impact T-junction to approximately that of the wet steam entering the inlet leg of the junction.

3. The Prior Art

In most steam flow situations, in which wet steam from a source or generator is distributed through a pipe network to various users, there is a phenomenon known as "Phase Splitting". This means that the liquid and vapor phases of the wet steam separate with the lighter vapor phase generally moving axially along the pipe at high velocity while the heavier liquid phase tends to become annular in shape and forms a liquid film which adheres to and moves along the inside wall of the pipe. The liquid phase is substantially evenly distributed around the internal circumference of the pipe with respect to a vertical diameter through the pipe. When such phase separated wet steam encounters a pipe junction, such as an impact T junction conventionally used to distribute the wet steam to different locations within a system, the result may be steam of differing quality exiting the respective legs of the junction. In a large steam distribution system the wet steam flow may encounter many such impact T junctions before finally reaching the point where it will be utilized. Phase spitting compounds itself and, in the worst case, could result in some portions of a large steam distribution system receiving as much as 100 percent vapor whereas other portions of the same distribution system might receive as much as 100 percent liquid.

Steam generators normally produce wet steam in a quality range of 70% to 80%. Historically, steam quality at the end use site has varied from 0% to 100%. One reason for this change is that at each impact T junction in the distribution system can result in the steam quality at each outlet of the junction can varying by 10 quality points or more, even as high as a 30/70 mass split. An ideal steam distribution system would be designed so there is an equal mass split of the wet steam at each junction. However, mass splits at the outlet legs of T junctions often vary from 20% to 80% of the steam mass into the inlet leg due to operating and physical constraints. The result of this unequal vapor and liquid mass split at impacting T junctions is a difference in steam quality in each of the T junction outlet streams.

Steam quality at the inlet to an impact T junction is identified as $X_1$ and steam quality for the respective outlets is identified as $X_2$ and $X_3$. $W_1$, $W_2$ and $W_3$ identify the mass rates in each leg of a T junction with the first being the inlet and the others the outlets. The ratio of outlet to inlet steam quality, $X_2/X_1$ and $X_3/X_1$, describes the change in steam quality and is referred to as phase splitting. Phase splitting was measured for vapor mass extraction ratios, $F_{g3}=W_3/W_1$, from 0.2 to 0.8.

Most steam distribution systems operate in either a segregated or an annular flow regime. In the segregated flow regime the liquid phase occupies only a small bottom segment of the pipe's cross-section while the vapor phase fulls the rest of the pipe's interior. In the annular flow regime the liquid phase forms an annular film adhering to the pipe's inner circumference. Both of these flow patterns are symmetrical with respect to the pipe's vertical diameter or centerline. This symmetry of the flow pattern and T junction installation can be used to promote equal liquid phase flow into each outlet leg of an impact T junction. This tendency for equal amounts of liquid phase to flow from each outlet leg of an impact T junction results in unequal outlet steam qualities downstream of the impact T junction as the vapor extraction ratio changes from 0.5. Steam distribution systems often are designed with pipe junction mass extraction ratios of 0.3 to 0.7. Hence, there is a need for a device that will maintain equal outlet steam qualities over a wide range of junction outlet mass extraction ratios.

SUMMARY OF THE INVENTION

The present invention minimizes the difference in steam quality in the outlet legs of an impact T junction. The invention places a particular type of static mixer means with the elements thereof installed with a specific orientation and at a designated location, with respect to the geometric center of the junction's inlet leg and outlet legs. A downstream element of the static mixer means must be installed with its plates vertical and the downstream end of the mixer element in the range of one-half to one pipe diameter from the geometric center of the T junction.

BRIEF DESCRIPTION OF THE DRAWINGS

The present invention will now be described, by way of example, with reference to the accompanying drawings in which.

DESCRIPTION OF THE PREFERRED EMBODIMENT OF THE INVENTION

Figure 1:
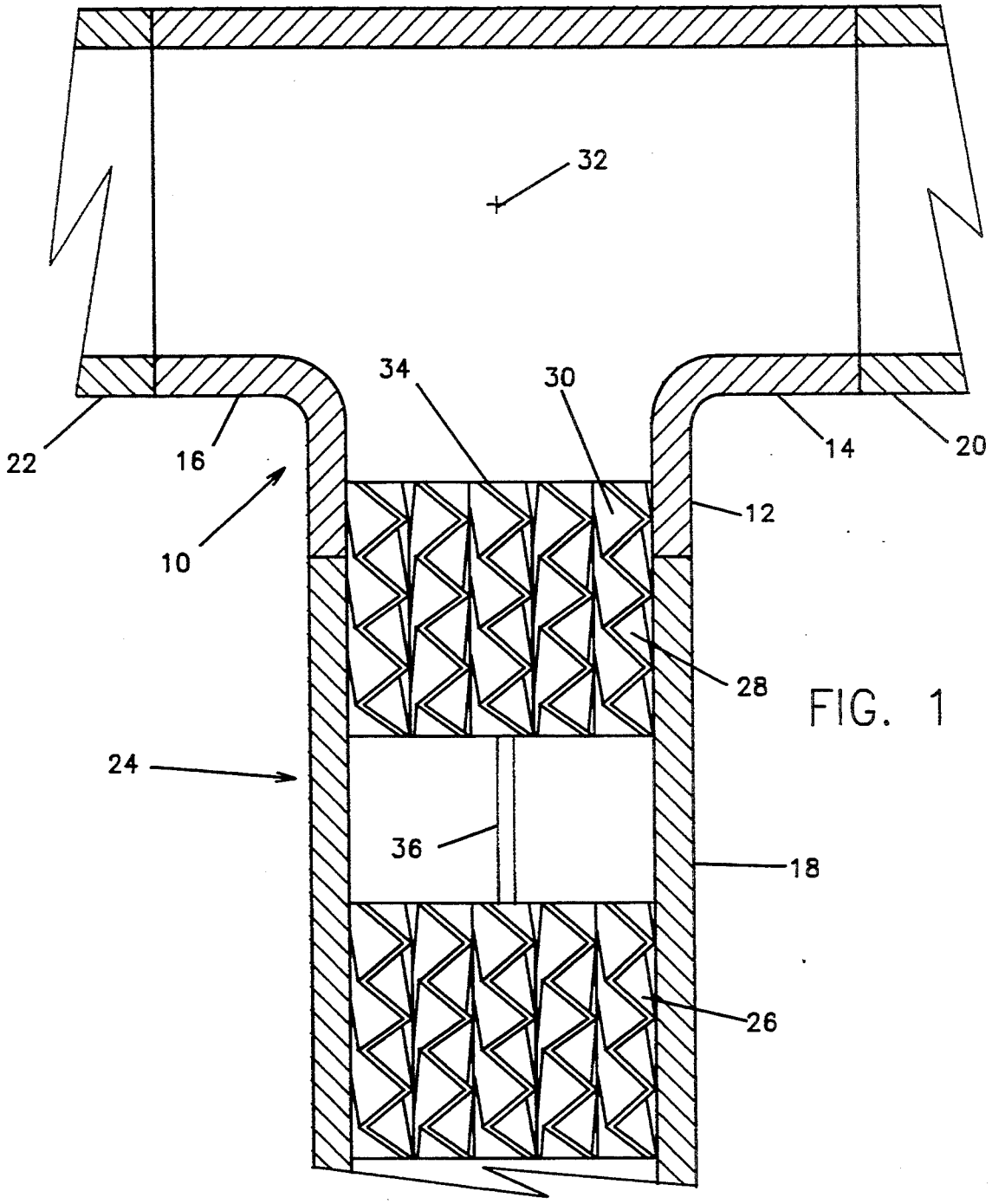
FIG. 1 is a diagrammatic horizontal section through an impact T junction in accordance with the present invention.
Figure 2:
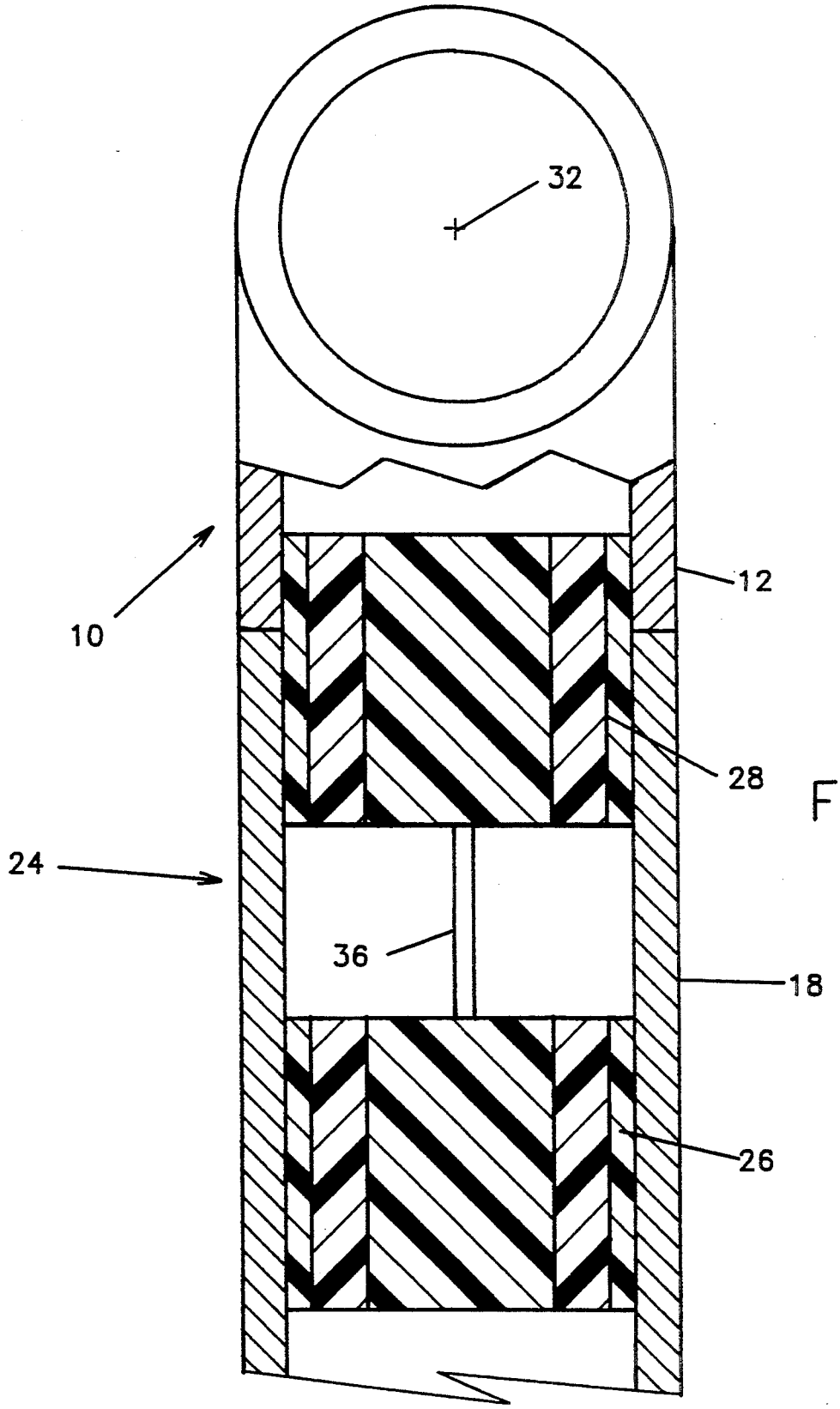
FIG. 2 is a side elevation, partially in section, of the impact T junction of FIG. 1.

The embodiment of the present invention shown in FIG. 1 is formed by a standard impact T junction 10 having an inlet leg 12 and a pair of oppositely directed outlet legs 14, 16, each connected to respective conduits 18, 20, 22. The longitudinal axes of the inlet leg and outlet legs intersect to define a preferably horizontally oriented plane. The T junction 10 is installed as an impact T so the fluid enters the inlet branch 12 and exits the two outlet legs or run legs 14, 16. Static mixer means 24, here shown comprising two substantially identical static mixer units 26, 28, are installed in the inlet conduit 18 extending into the inlet leg 12 of the junction 10.

Figure 3:
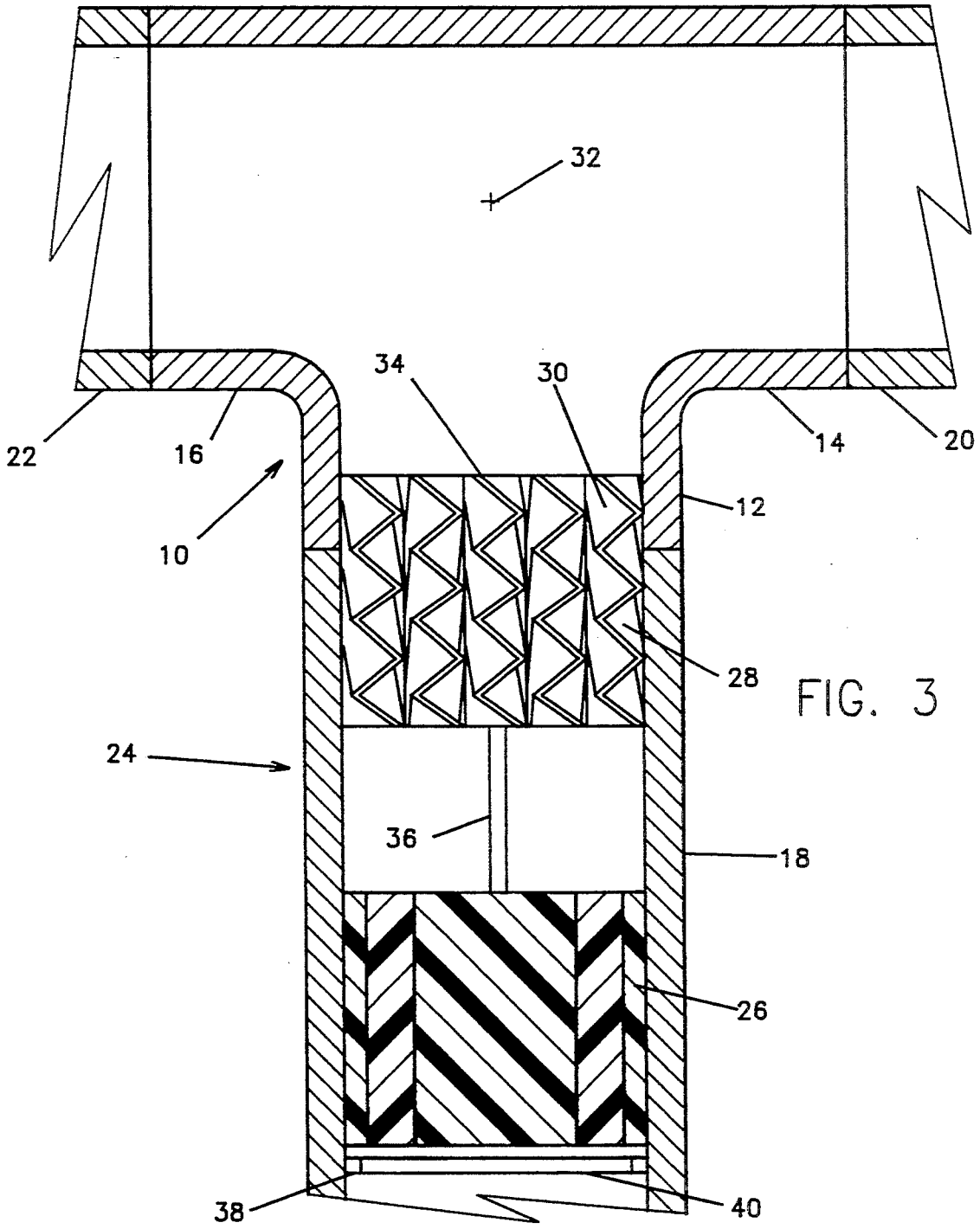
FIG. 3 is a diagrammatic horizontal section, similar to FIG. 1, showing as alternate embodiment of the present invention.

Each unit 26, 28 of the illustrated preferred static mixer means 24 is formed by a plurality of lamella 30, each of which are corrugated. The corrugations of all the lamella are of substantially equal slope and corrugations of adjacent lamella are disposed at intersecting directions to define a plurality of tortuous paths for the steam flow. Preferably there are two static mixer units 26, 28, as illustrated, forming the static mixer means 24 with the units slightly spaced. Separator means 36 can be placed between the units 26, 28 to assure proper separation. The separator means can be a simple pin, plate, or combination of plates, the only requirement being that it does not restrict the flow. The units 26, 28 can be mounted with their lamella aligned, as shown in FIG. 1, or angularly offset with respect to each other, for example 90° as shown in FIG. 3. This type of static mixer tends to impart radial velocity to the steam and the magnitude and direction of this radial velocity component influences the outlet steam qualities as the total mass ratios in both outlet legs vary. Thus it is important that the downstream mixer unit 28 have its lamella 30 substantially vertical i.e. normal to the longitudinal axis of the outlet legs 14, 16 and perpendicular to the plane of the horizontally disposed junction 10, as defined by the intersecting axes of the inlet leg and outlet legs.

The distance from the end of the downstream mixer unit 28 of the mixer means 24 to the geometric center 32 of the junction 10 is also an important factor to maintain an equal quality in both outlet streams with unequal mass rates. A two phase fluid will return to its normal separated phase flow regime within several pipe diameters of a mixer unit. Therefore the outlet end 34 of the mixer unit 28 must be placed with respect to the geometric center 32 of the T junction so as to minimize separation of the liquid phase from the vapor phase before the fluid reaches the geometric center 32. A distance of 1 to 0.75 pipe diameters from the geometric center 32 of the junction 10 has been found to be the optimum spacing. It is also preferred that, when multiple mixer units are utilized, they be spaced apart 0.5 to 1.0 pipe diameters.

The static mixer means 24 must be installed with the lamella plates in the downstream unit 28 in a vertical plane while the outlet legs 14, 16 are in a horizontal plane. This orientation reduces the flow of liquid toward either outlet leg of the T junction. If the mixer vanes or plates are not vertical, they preferentially direct the liquid phase toward one or the other of the two outlet legs.

Several types of mixer means, each with a different plate or vane configuration representing the basic types of mixer designs on the commercial market, are readily available. Examples of these mixers are shown in U.S. Pat. Nos. 3,599,943; 3,785,620; 4,062,524; 4,731,229; and 4,919,541, the disclosures of which are incorporated herein by reference. Particular attention is directed to U.S. Pat. Nos. 4,062,524 and 4,731,229 for their illustrations of the alternating orientation of adjacent lamella and to U.S. Pat. No. 4,919,541 for its illustration of alternate orientation of successive static mixer units.

A preferred mixer is a two element Koch Model SMV mixer. This is a Type BX static mixer which has plate slots or crimps at 30° to the flow centerline to reduce pressure loss through the mixer unit. The Koch static mixer is made with at least five parallel, crimped plates, which leaves areas around the circumference of the inlet conduit where the fluid can flow between a mixer plate and the adjacent pipe wall without diversion. Thus it is preferable to mount a plate 38 defining an orifice 40 on at least the upstream face of the mixer means 24 to close off these open areas and divert liquid phase flow into the tortuous path region. Any such orifice plate must be symmetrical with respect to the axis of the inlet leg or else they will direct the liquid phase toward one or the other of the two outlet legs. These orifice plates also increase the pressure drop across the mixer means. Such a plate is shown with the alternate embodiment in FIG. 3.

The present invention may be subject to many modifications and changes by one skilled in the art without departing from the spirit or essential characteristics thereof. The present embodiment should therefore be considered in all respects as illustrative and not restrictive of the scope of the invention as defined by the appended claims.

We claim:

1. An assembly for equalizing the quality of wet steam in the outlets of an impacting T junction, comprising, in combination:

a T junction having an inlet leg and a pair of oppositely directed outlet legs, the central longitudinal axes of said inlet leg and said outlet legs defining a plane and intersecting at substantially the geometric center of said T junction;

a conduit member having upstream and downstream ends with said downstream end connected to the inlet leg of said T junction;

static mixer means mounted in said conduit member with one end of said mixer means extending at least partially into said inlet leg of said T junction, said static mixer means having a plurality of corrugated lamellas, the corrugations on adjacent lamella being substantially equal in height and shape and disposed at intersecting directions, and at least said lamellas extending at least partially into said inlet leg having an orientation substantially normal with respect to the plane of said T junction.

2. The combination according to claim 1 wherein the downstream end of said static mixer means is 0.75 to 1 pipe diameters from the geometric center of said T junction.

3. The combination according to claim 1 wherein said static mixer means comprises substantially identical upstream and downstream units.

4. The combination according to claim 3 wherein said upstream unit is spaced 0.5 to 1.0 pipe diameters from said downstream unit.

5. The combination according to claim 3 wherein said upstream unit has its lamella non-aligned with respect to the lamella of the downstream unit, the lamella of the downstream unit being oriented substantially normal with respect to the plane of the T junction.

6. The combination according to claim 5 wherein said upstream unit has its lamella oriented normal to the lamella of the downstream unit.

* * * * *